US007043950B2

(12) United States Patent
Clark et al.

(10) Patent No.: US 7,043,950 B2
(45) Date of Patent: May 16, 2006

(54) MEASURING DEVICE FOR MEASURING A SHEET OF MATERIAL IN A SHEET BENDING BRAKE

(75) Inventors: Michael C. Clark, Columbiaville, MI (US); Benjamin L. Pinchback, Lake Orion, MI (US); Clyde G. Allen, Lapeer, MI (US)

(73) Assignee: Tapco International Corporation, Wixom, MI (US)

( * ) Notice: Subject to any disclaimer, the term of this patent is extended or adjusted under 35 U.S.C. 154(b) by 55 days.

(21) Appl. No.: 10/870,886

(22) Filed: Jun. 17, 2004

(65) Prior Publication Data

US 2005/0016236 A1 Jan. 27, 2005

Related U.S. Application Data

(60) Provisional application No. 60/479,200, filed on Jun. 17, 2003.

(51) Int. Cl.
*B21D 5/04* (2006.01)

(52) U.S. Cl. ..... 72/31.1; 72/319

(58) Field of Classification Search ..... 72/319–321, 72/461, 31.1, 31.12
See application file for complete search history.

(56) References Cited

U.S. PATENT DOCUMENTS 3,815,393 A * 6/1974 Daniels ..... 72/6.1
3,826,119 A 7/1974 Marotto
4,055,070 A * 10/1977 Wingate et al. ..... 72/461
5,259,230 A 11/1993 Beyers
5,582,053 A 12/1996 Chubb et al.
5,630,336 A 5/1997 Jorgenson
5,661,996 A 9/1997 Welty
5,706,692 A 1/1998 Chubb et al.
5,761,939 A 6/1998 Spencer et al.
6,000,268 A 12/1999 Van Cleave et al.
6,082,164 A * 7/2000 Palmer ..... 72/319
6,408,527 B1 6/2002 Chubb
6,532,789 B1 3/2003 Chubb et al.
6,748,783 B1 6/2004 Chubb et al.
6,748,784 B1 6/2004 Chubb et al.

FOREIGN PATENT DOCUMENTS

JP 02012448 9/1991

* cited by examiner

*Primary Examiner*—Daniel C. Crane
(74) *Attorney, Agent, or Firm*—Howard & Howard

(57) ABSTRACT

The subject invention presents a sheet bending brake assembly and a measuring device for the sheet bending brake assembly. The assembly includes a support. First and second clamping members are mounted on the support for movement between open and closed positions. The clamping members have respective clamping surfaces that extend in a parallel and opposing relationship to each other in the closed position to clamp a sheet of material between the surfaces. The measuring device is for measuring the sheet of material relative to the clamping members. The measuring device includes a base and an elongated arm pivotally connected to the base at a pivot. The elongated arm extends from the pivot to a distal end for pivotal movement about the pivot between a retracted position and an extended measuring position for overlying the sheet of material.

20 Claims, 2 Drawing Sheets

MEASURING DEVICE FOR MEASURING A SHEET OF MATERIAL IN A SHEET BENDING BRAKE

RELATED APPLICATIONS

This patent application claims priority to and all advantages of U.S. Provisional Patent Application No. 60/479,200, which was filed on Jun. 17, 2003.

BACKGROUND OF THE INVENTION

1. Field of the Invention

This invention generally relates to measurement devices for sheet bending brake assemblies and, more particularly, to measurement devices for measuring a sheet of material in sheet bending brakes.

2. Description of the Prior Art

Sheet bending brake assemblies have been used for many years to selectively form sheet s of metal into various configurations. One primary use of such brakes is to form siding used to finish the exterior of a building.

Measurement devices for measuring various dimensions are known in the art and include such devices as measuring sticks and tape measures. Such measurement devices, when used in conjunction with sheet bending brakes, can be awkward for an operator of the brake to use while operating the brake and/or one of its accessories, and dramatically increase the time it takes to make proper measurements of sheets of material to be cut or formed on the sheet bending brake. In addition, the measurement devices of the prior art cannot be mounted on the brake assemblies in both a convenient position to be readily available when needed, yet positioned out of the way from operation of the brake assemblies when no longer used.

For example, U.S. Pat. No. 5,661,996 discloses a standard retractable tape measure mounted to the brake assembly. The brake assembly includes a carriage assembly for supporting sheet metal to be bent. A tape portion of the tape measure is connected to the carriage assembly and moves along with the carriage assembly. The tape measure, however, is mounted to a side of the brake assembly, and is thus not easily observable to a person positioning the sheet metal in the brake assembly. Furthermore, the tape measure is prone to damage since the tape portion remains on the carriage assembly during operation of the brake assembly.

Thus, it would be advantageous to develop a measurement device, or measuring device, which overcomes the deficiencies in the prior art.

SUMMARY OF THE INVENTION AND ADVANTAGES

The subject invention presents a sheet bending brake assembly and a measuring device for the sheet bending brake assembly. The assembly includes a support. First and second clamping members are mounted on the support for movement between open and closed positions. The clamping members have respective clamping surfaces that extend in a parallel and opposing relationship to each other in the closed position to clamp a sheet of material between the surfaces. The measuring device is for measuring the sheet of material relative to the clamping members. The measuring device includes a base and an elongated arm pivotally connected to the base at a pivot. The elongated arm extends from the pivot to a distal end for pivotal movement about the pivot between a retracted position and an extended measuring position for overlying the sheet of material.

An advantage of the subject invention is the elongated arm may be pivoted into the retracted position to be out of the way of operation of the brake assembly when not in use, and pivoted into the extended measuring position when in use. Another advantage is the elongated arm is not prone to damage during operation or transportation.

DETAILED DESCRIPTION OF THE SEVERAL VIEWS OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
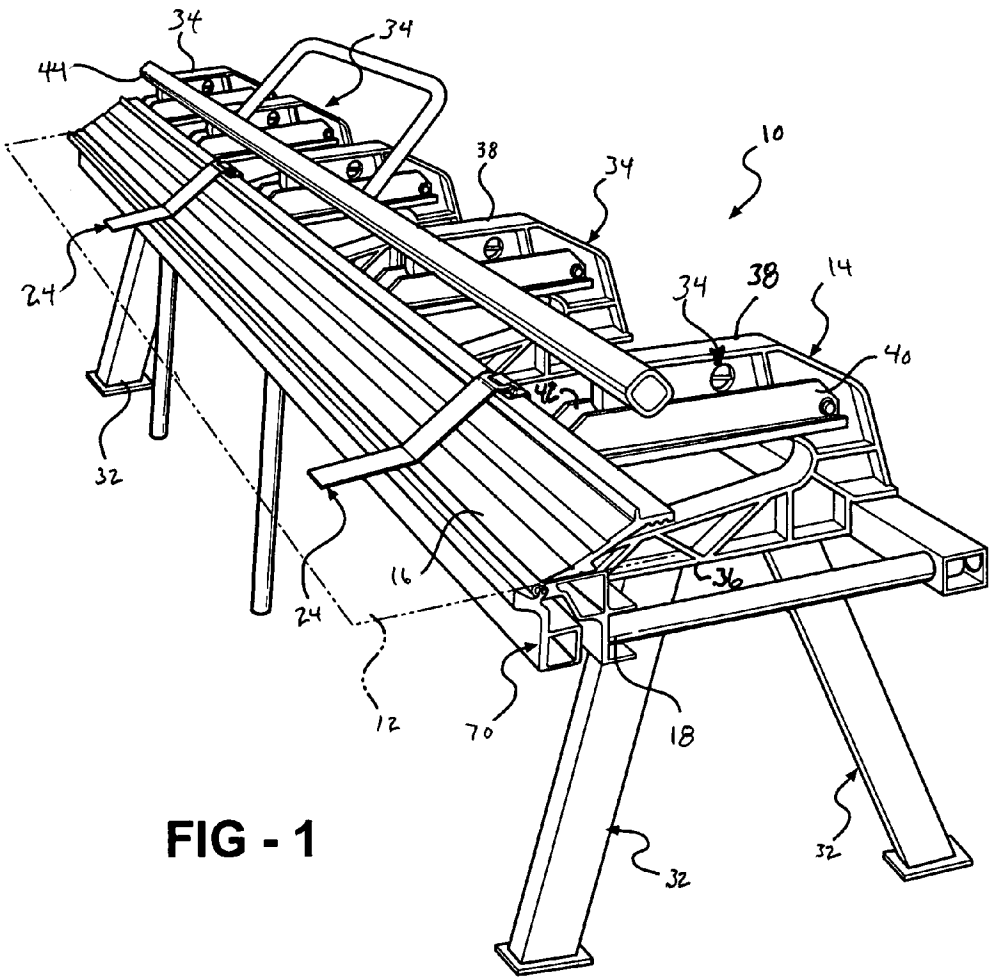
FIG. 1 is a perspective view of a sheet bending brake shown in use in conjunction with the measuring device of the subject invention.

The subject invention provides a sheet bending brake assembly, which is shown generally at 10 in FIG. 1. The brake assembly 10 is used for bending or otherwise forming sheets of material, such as metal, plastic, etc. The sheet bending brake assembly 10 includes a support 14. First and second clamping members 16, 18 are mounted on the support 14 for movement between open and closed positions. The clamping members 16, 18 have respective clamping surfaces 20, 22 that extend in parallel and opposing relationship to each other in the closed position to clamp the sheet of material 12 between the clamping surfaces 20, 22. The brake assembly 10 further includes a measuring device 24 for measuring the sheet of material 12 relative to the clamping members 16, 18. The measuring device 24 includes a base 26 and an elongated arm 28 pivotally connected to the base 26 at a pivot 30. The elongated arm 28 extends from the pivot 30 to a distal end for pivotal movement about the pivot 30 between a retracted position and an extended measuring position for overlying the sheet of material 12.

As best shown in FIG. 1, the support 14 for the brake assembly 10 includes support legs 32 for elevating the brake assembly 10. The support legs 32 are generally position at angles with respect to each other to maximize stability of the brake assembly 10. The support 14 further includes longitudinally spaced c-shaped frame members 34. Each frame member 34 includes a lower arm 36 and an upper arm 38 which overlies the lower arm 36 in spaced relation thereto.

Preferably, the first clamping member 16 is a movable clamping member 16. Means are provided for moving the first clamping member 16 between the open and closed positions, i.e., away from and toward the second clamping member 18 respectively, to clamp the sheet of material 12 between the clamping members 16, 18. In a preferred embodiment, shown in FIG. 1, the first clamping member 16 is pivotally supported by the support 14 for movement between the open position and the closed position. However, it is to be appreciated that other means are also suitable for moving the first clamping member 16, such as means for providing rectilinear movement of the first clamping member 16 between the open and closed positions.

Referring to FIG. 1, the support 14 preferably includes pivot bars 40 that support 14 the first clamping member 16. The pivot bars 40 extend between the first clamping member 16 and the c-shaped frame members 34 and are pivotally attached to the frame members 34. The pivot bars 40 each define channels 42 that matingly receive the corresponding upper arm 38 of the frame members 34 for guiding the pivot bars 40 as the pivot bars 40 pivot during operation of the brake assembly 10. The pivot bars 40 extend beyond respective ends of the upper arm 38 to position the first clamping member 16 beyond the upper arms 38. The second clamping member 18 is fixed to the c-shaped frame members 34 on the respective lower arms 36 and positioned to align with the first clamping member 16 to provide a means for clamping the sheet of material 12.

A handle member 44 is pivoted to the upper arm 38 of each c-shaped frame member 34 and to the pivot bars 40 by a plurality of extensible links (not shown). The extensible links are pivoted at an upper end to the handle member 44 and at a lower end to the pivot bars 40. The extensible links may be of the type shown in U.S. Pat. No. 4,766,757, issued Aug. 30, 1988, U.S. Pat. No. 5,582,053, issued Dec. 10, 1996, and similar sheet bending brakes, incorporated herein by reference.

Figure 3:
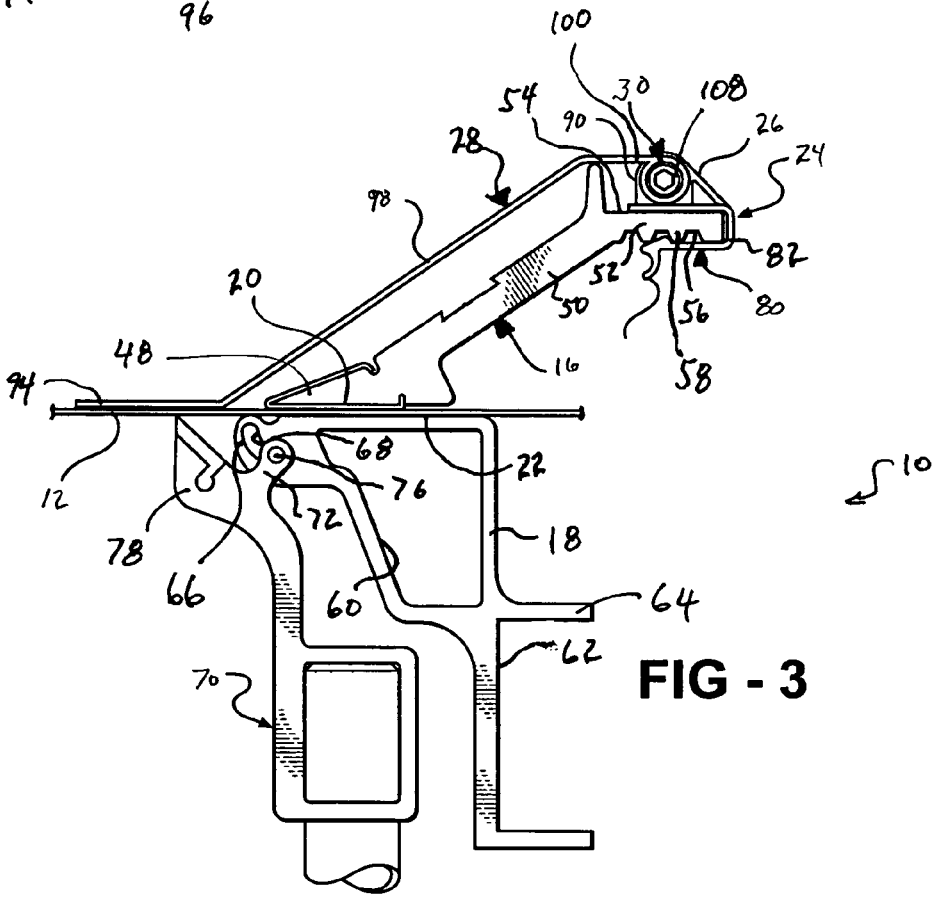
FIG. 3 is a side view of the sheet bending brake including the measuring device of FIG. 1 with the elongated arm pivoted in the extended measuring position.

Referring to FIG. 3, the first clamping member 16 includes an anvil portion 48 positioned proximal to the second clamping member 18. During operation of the brake assembly 10, the sheet of material 12 is bent about the anvil portion 48, as will be described in further detail below. A slanted portion 50 extends from the anvil portion 48 to support 14 the anvil portion 48. A rear portion 52 extends from the slanted portion 50 and provides an upper surface 54 for attachment of the first clamping member 16 to the pivot bars 40. The rear portion 52 also provides a bottom surface 56 that defines a series of ribs 58. Preferably, the ribs 58 extend along a length of the first clamping member 16.

The second clamping member 18 includes an upper tubular portion 60 and a lower tubular portion 62. The lower tubular portion 62 includes spaced flanges 64. The second clamping member 18 is fixed to the support 14, more specifically the lower arms 36, at the spaced flanges 64. The second clamping member 18 extends to a projection 66, preferably a plurality of projections 66, adjacent the clamping surface 22 of the second clamping member 18. The projections 66 project beyond the first clamping member 16. Each projection 66 has a slot 68 formed therein and the slots 68 of the various projections 66 are in longitudinal alignment.

A bending member 70 includes corresponding projections 72 that mesh with the projections 66 of the second clamping member 18. The corresponding projections 72 have openings, with pins 76 extending through the openings and corresponding slots 76 to hinge the bending member 70 to the second clamping member 18. The bending member 70 further includes a bending portion 78 that extends upwardly and outwardly when the bending member 70 is in a position for bending the sheet of material 12.

Figure 4:
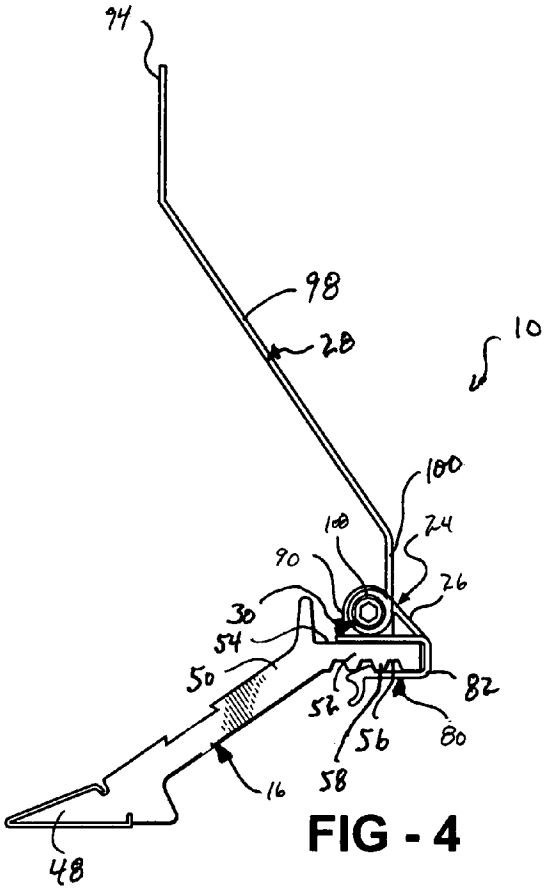
FIG. 4 is a partial side view of the measuring device mounted to a clamping member with the elongated arm pivoted in the retracted position.

Referring to FIGS. 1, 3, and 4, the measuring device 24 is mounted on the sheet bending brake assembly 10 for measuring the sheet of material 12 extending from the clamping members 16, 18 when the sheet of material 12 is clamped between the clamping members 16, 18. At least one measuring device 24 is mounted to the sheet bending brake assembly 10. Preferably, at least two measuring devices 24 are mounted to the sheet bending brake assembly 10.

Figure 2:
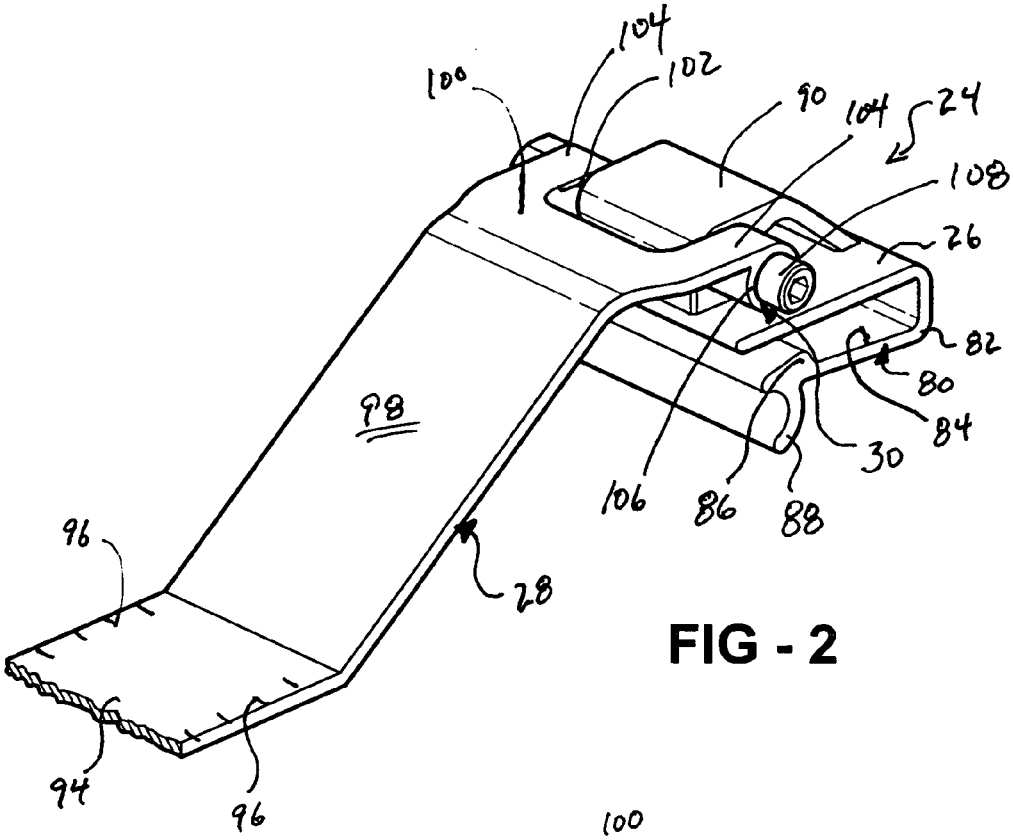
FIG. 2 is a perspective view of the measuring device of FIG. 1 with an elongated arm pivoted in an extended measuring position.

Preferably, as shown in FIGS. 2–4, the base 26 of the measuring device 24 includes a clip 80 for clipping the base 26 onto the brake assembly 10. More specifically, the clip 80 is preferably integral with the base 26 and defines a c-shaped bracket 82. In a preferred embodiment, the c-shaped bracket 82 biasingly engages the first clamping member 16. The c-shaped bracket 82 has an inner surface 84. A flange 86 may be disposed on the inner surface 84 adjacent an end of the c-shaped bracket 82, removed from the base 26, for interacting with at least one of the ribs 58 on the first clamping member 16 to secure the base 26 on the brake assembly 10. The c-shaped bracket 82 also includes a tab 88, which may be lifted to release the c-shaped bracket 82 from the first clamping member 16. Thus, the measuring device 24 may be moved along the length of the first clamping member 16 to measure the sheet of material 12 at various positions along the length of the brake assembly 10. It is to be appreciated that the base 26 may include any variety of mechanisms for securing the measuring device 24 to the brake assembly 10 and, more specifically, the first clamping member 16. For example, the c-shaped bracket 82 may include a spring-loaded post (not shown) that extends through the c-shaped bracket 82, adjacent the flange 86, to interact with at least one of the ribs 58 on the first clamping member 16. Alternatively, the c-shaped bracket 82 may include a screw (not shown) for securing the base 26 onto the first clamping member 16.

Preferably, the base 26 further includes a hinge wrap 90, which forms part of the pivot 30. The hinge wrap 90 defines a hole (not shown) extending through the hinge wrap 90. The elongated arm 28 is pivotally mounted to the base 26 at the hinge wrap 90, to be described in further detail below.

Preferably, as shown FIG. 3, the elongated arm 28 is defined by an integral plate and includes a scale portion 94 at the distal end. The elongated arm 28 extends over the second clamping member 18 to position the scale portion 94 outside of the projection 66 when the elongated arm 28 is in the measuring position. Preferably, the elongated arm 28 includes a series of reference markings 96 disposed along the scale portion 94 for measuring the sheet of material 12. The reference markings 96 can be spaced according to metric units, English units, or any other unit of measure. Preferably, the reference markings 96 are etched onto a surface of the scale portion 94. Alternatively, the reference markings 96 may be painted onto the surface of the scale portion 94 or included on a label fixed to the scale portion 94 with an adhesive.

The scale portion 94 extends generally parallel to the clamping surfaces 20, 22 when the elongated arm 28 is in the measuring position. The elongated arm 28 has a center length 98 slanting upwardly from the scale portion 94 and a hinge portion 100 extending from the center length 98 to the pivot 30. Preferably, the scale portion 94 and the hinge portion 100 are generally parallel whereby the elongated arm 28 is generally z-shaped. Thus, the elongated arm 28 defines a shape to complement a shape of the slanted portion 50 of the first clamping member 16 such that when the elongated arm 28 is pivoted into the measuring position, the scale portion 94 is relatively parallel to the surface of the sheet of material 12.

The hinge portion 100 defines a cutout 102 to define bifurcated legs 104, which form part of the pivot 30. The bifurcated legs 104 wrap around an axis to form annular knuckles 106 and are positioned on either side of the hinge wrap 90, with the annular knuckles 106 coaxial with the hinge wrap 90. A shaft 108 passes through the hinge wrap 90 and the annular knuckles 106 for forming the pivot 30 and connecting the elongated arm 28 to the base 26. The shaft 108 creates a pivot 30 axis for allowing the pivotal movement of the elongated arm 28 between the measuring position along the sheet of material 12 and the retracted position, spaced from the sheet of material 12.

Referring to FIG. 3, the measuring device 24 is illustrated in a measuring position on the brake assembly 10 for measuring the sheet of material 12. As shown in FIG. 4, the elongated arm 28 is pivoted into the retracted position, removed from the sheet of material 12, to allow operation of the brake assembly 10.

In use, as shown in FIG. 3, the sheet of material 12 is drawn between the first clamping member 16 and the second clamping member 18, along the respective clamping surfaces 20, 22. The handle is pivoted, which in turn pivots the first clamping member 16, to clamp the sheet of material 12 against the second clamping member 18 in preparation for bending of the sheet of material 12. The measuring device 24 is pivoted into the measuring position to measure a length of the sheet of material 12 extending from the brake assembly 10. The measuring device 24 may be moved to a different position along the length of the first clamping member 16 to measure the length of the sheet of material 12 at a different point. The elongated arm 28 is pivoted into the second position in preparation for operation of the sheet bending brake assembly 10.

Obviously, many modifications and variations of the present invention are possible in light of the above teachings. The invention may be practiced otherwise than as specifically described within the scope of the appended claims. In addition, the reference numerals in the claims are merely for convenience and are not to be read in any way as limiting.

What is claimed is:

1. A sheet bending brake assembly 10 comprising:

a support 14;

first and second clamping members 16, 18 mounted on said support 14 for movement between open and closed positions and having respective clamping surfaces 20, 22 for extending in parallel and opposing relationship to each other in said closed position to clamp a sheet of material 12 therebetween;

a measuring device 24 for measuring the sheet of material 12 relative to said clamping members 16, 18;

said assembly 10 characterized by said measuring device 24 including a base 26 and an elongated arm 28 pivotally connected to said base 26 at a pivot 30 and extending from said pivot 30 to a distal end for pivotal movement about said pivot 30 between a retracted position and an extended measuring position for overlying the sheet of material 12 with said elongated arm 28 including a scale portion 94 at said distal end.

2. An assembly 10 as set forth in claim 1 wherein said base 26 includes a clip 80 for clipping said base 26 onto said assembly 10.

3. An assembly 10 as set forth in claim 1 wherein said second clamping member 18 is fixed to said support 14 and extends to a projection 66, said elongated arm 28 extending over said second clamping member 18 to position said scale portion 94 outside of said projection 66 in said measuring position.

4. An assembly 10 as set forth in claim 3 wherein said first clamping member 16 is a movable clamping member 16 pivotally supported by said support 14 for movement between said open position and said closed position, said base 26 being attached to said movable clamping member 16.

5. An assembly 10 as set forth in claim 4 wherein said base 26 includes a clip 80 for removably clipping said base 26 onto said assembly 10.

6. An assembly 10 as set forth in claim 4 wherein said scale portion 94 extends generally parallel to said clamping surfaces 20, 22 in said measuring position.

7. An assembly 10 as set forth in claim 6 wherein said elongated arm 28 has a center length 98 slanting upwardly from said scale portion 94 and a hinge portion 100 extending from said center length 98 to said pivot 30.

8. An assembly 10 as set forth in claim 7 wherein said scale portion 94 and said hinge portion 100 are generally parallel whereby said elongated arm 28 is generally z-shaped.

9. An assembly 10 as set forth in claim 8 wherein said hinge portion 100 defines a cutout 102 to define bifurcated legs 104 wrapping around an axis to form annular knuckles 106.

10. An assembly 10 as set forth in claim 9 wherein said elongated arm 28 is defined by an integral plate.

11. An assembly 10 as set forth in claim 10 wherein said base 26 further includes a hinge wrap 90 defining a hole extending therethrough.

12. An assembly 10 as set forth in claim 11 wherein said bifurcated legs 104 are positioned on either side of said hinge wrap 90 with said annular knuckles 106 coaxial with said hinge wrap 90.

13. An assembly 10 as set forth in claim 12 further including a shaft 108 passing through said hinge wrap 90 and said annular knuckles 106 for connecting said elongated arm 28 to said base 26.

14. An assembly 10 as set forth in claim 13 wherein said clip 80 is integral with said base 26 and defines a c-shaped bracket 82.

15. An assembly 10 as set forth in claim 14 wherein said c-shaped bracket 82 has an inner surface 84 and a flange 86 disposed on said inner surface 84 for securing said base 26 on said assembly 10.

16. A sheet bending brake assembly 10 comprising:

a support 14;

first and second clamping members 16, 18 mounted on said support 14 for movement between open and closed positions and having respective clamping surfaces 20, 22 for extending in parallel and opposing relationship to each other in said closed position to clamp a sheet of material 12 therebetween;

a measuring device 24 for measuring the sheet of material 12 relative to said clamping members 16, 18;

said measuring device 24 including a base 26 having a clip 80 for clipping said base 26 onto said assembly 10 and an elongated arm 28 pivotally connected to said base 26 at a pivot 30 and extending from said pivot 30 to a distal end for pivotal movement about said pivot 30 between a retracted position and an extended measuring position for overlying the sheet of material 12.

17. An assembly 10 as set forth in claim 16 wherein said elongated arm 28 includes a scale portion 94 at said distal end, said second clamping member 18 being fixed to said support 14 and extending to a projection 66, said elongated arm 28 extending over said second clamping member 18 to position said scale portion 94 outside of said projection 66 in said measuring position.

18. An assembly 10 as set forth in claim 17 wherein said first clamping member 16 is a movable clamping member 16 pivotally supported by said support 14 for movement between said open position and said closed position, said base 26 being attached to said movable clamping member 16.

19. An assembly 10 as set forth in claim 16 wherein said clip 80 is integral with said base 26 and defines a c-shaped bracket 82.

20. An assembly 10 as set forth in claim 19 wherein said c-shaped bracket 82 has an inner surface 84 and a flange 86 disposed on said inner surface 84 for securing said base 26 on said assembly 10.

* * * * *